US007717416B2

(12) United States Patent
Mitsuya et al.

(10) Patent No.: US 7,717,416 B2
(45) **Date of Patent: *May 18, 2010**

(54) PAPER SHEET SEPARATION AND TRANSFER APPARATUS

(75) Inventors: Yusuke Mitsuya, Yokohama (JP); Yoshihiko Naruoka, Yokohama (JP); Yukio Asari, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/797,449

(22) Filed: May 3, 2007

(65) Prior Publication Data

US 2007/0210506 A1 Sep. 13, 2007

Related U.S. Application Data

(62) Division of application No. 10/932,351, filed on Sep. 2, 2004, now Pat. No. 7,270,326.

(30) Foreign Application Priority Data

Sep. 3, 2003 (JP) ..... 2003-311594

(51) Int. Cl.
*B65H 3/06* (2006.01)

(52) U.S. Cl. ..... 271/114; 271/122

(58) Field of Classification Search ..... 271/10.11, 271/10.03, 21, 110, 111, 114, 116, 265.04, 271/262, 121, 122
See application file for complete search history.

(56) References Cited

U.S. PATENT DOCUMENTS 4,030,722 A 6/1977 Irvine et al.
4,030,723 A 6/1977 Irvine et al.
4,083,555 A 4/1978 Irvine et al.
4,203,586 A * 5/1980 Hoyer ..... 271/34
4,436,298 A 3/1984 Donner et al.
5,029,837 A * 7/1991 Uchiyama ..... 271/110
5,384,631 A * 1/1995 Matsunami ..... 399/370
5,462,267 A 10/1995 Hori
5,882,002 A * 3/1999 Kamei et al. ..... 271/118
6,345,817 B1 2/2002 Kakegawa et al.

(Continued)

FOREIGN PATENT DOCUMENTS

EP 1 077 190 A2 2/2001

(Continued)

OTHER PUBLICATIONS

European Search Report dated May 23, 2007 for Appln. No. 04021014.8-1256.

(Continued)

*Primary Examiner*—Patrick Mackey
*Assistant Examiner*—Jeremy Severson
(74) *Attorney, Agent, or Firm*—Pillsbury Winthrop Shaw Pittman, LLP

(57) ABSTRACT

A paper sheet separation and transfer apparatus has a take-out roller which takes out stacked paper sheets onto a transfer path, a first separation unit, and a second separation unit. When the front end of a first paper sheet in the transfer direction reaches a nip of the second separation unit, the take-out roller and first feed roller are "decelerated".

3 Claims, 5 Drawing Sheets

U.S. PATENT DOCUMENTS

| | | | | |
|---|---|---|---|---|
| 6,540,220 | B2 | 4/2003 | Kuo et al. | |
| 7,007,945 | B2 | 3/2006 | Hiramitsu | |
| 7,052,008 | B2 | 5/2006 | Mitsuya et al. | |
| 7,588,245 | B2 * | 9/2009 | Mandel et al. | 271/122 |
| 7,654,523 | B2 * | 2/2010 | Tsukamoto et al. | 271/262 |
| 2004/0245698 | A1 | 12/2004 | Naruoka | |
| 2006/0214356 | A1 * | 9/2006 | Yasukawa et al. | 271/10.13 |

FOREIGN PATENT DOCUMENTS

| | | |
|---|---|---|
| JP | 59-012029 | 1/1984 |
| JP | 59-12029 | 1/1984 |
| JP | 10-087088 | 4/1998 |
| JP | 2000-044069 | 2/2000 |
| JP | 2003-81463 | 3/2003 |

OTHER PUBLICATIONS

Japanese Office Action dated Jun. 10, 2008 for Appln. No. 2003-311594.

European Search Report dated Jun. 17, 2009 for Appln. No. 04021014.8-1256.

* cited by examiner

PAPER SHEET SEPARATION AND TRANSFER APPARATUS

CROSS-REFERENCE TO RELATED APPLICATIONS

This application is a divisional of co-pending U.S. application Ser. No. 10/932,351, filed Sep. 2, 2004, and for which priority is claimed under 35 U.S.C. §121. This application is based upon and claims the benefit of priority under 35 U.S.C. §119 from the prior Japanese Patent Application No. 2003-311594, filed Sep. 3, 2003, the entire contents of both applications are incorporated herein by reference in their entireties.

BACKGROUND OF THE INVENTION

1. Field of the Invention

The present invention relates to a paper sheet separation and transfer apparatus which separates a plurality of stacked paper sheets such as postal matters, bills and plain-paper copies, one by one, and takes each sheet out onto a transfer path.

2. Description of the Related Art

As a conventional paper sheet separation and transfer apparatus, a separation and transfer apparatus having a separation unit to prevent overlapped paper sheet feeding has been known. (For example, refer to Jpn. Pat. Appln. KOKAI Publication No. 2003-81463.) This separation and transfer apparatus has a take-out roller which rotates and contacts a paper sheet at one end of a stack, and takes it out onto a transfer path, and a transfer path which transfers the taken-out paper sheet. On the transfer path of the downstream side of the take-out roller, a separation unit and a transfer unit are arranged close to each other along the paper sheet take-out direction.

The separation unit has a feed roller which contacts the paper sheet taken out onto the transfer path on the same side as the take-out roller and rotates forward, and a separation roller which is located opposite to the feed roller through the transfer path and separates second and subsequent paper sheets taken out together with the first sheet by giving them a reverse force (a tangential force).

The transfer unit has a drive roller which accepts the transfer direction end of a paper sheet passed through a nip between the feed roller and separation roller, and rotates forward, thereby pulling out the paper sheet from the nip of the separation unit and feeding it, and a pinch roller which is arranged opposite to the drive roller through the transfer path.

In the separation and transfer apparatus with the above structure, when stacked paper sheets are taken out onto the transfer path, the take-out roller is rotated first, and a paper sheet at one end of a stack is taken out onto the transfer path. In this case, by the friction between paper sheets, second and subsequent paper sheets may be taken out together with the first paper sheet. The taken-out second and subsequent paper sheets are separated by the separation unit, and transferred to a processing unit in a later stage through the transfer path.

The separation unit feeds forward the preceding first paper sheet by the feed roller, and rotates the separation roller in the reverse direction contacting the second and subsequent sheets overlapped with the first sheet, and separates these second and subsequent paper sheets by pushing them in the reverse direction.

However, in the above conventional unit, if the take-out roller takes out two paper sheets with different size and thickness, overlapped paper sheets may not by completely separated by one separation unit.

BRIEF SUMMARY OF THE INVENTION

It is an object of the present invention to provide a paper sheet separation and transfer apparatus which can separate and transfer stacked paper sheets with certainty.

In order to achieve the above object, according to an embodiment of the present invention, there is provided a paper sheet separation and transfer apparatus comprising a take-out roller which rotates and contacts a paper sheet at one end of a stack of a plurality of paper sheets, and takes out the paper sheet onto a transfer path; a first separation unit having a first feed roller which contacts the paper sheet taken out onto the transfer path and rotates forward, and a first separation roller which is pressed to the first feed roller through the transfer path, and separates second and following paper sheets taken out together with the first paper sheet by giving a reverse separating force; a second separation unit having a second feed roller which contacts the paper sheet passed through the first separation unit and rotates forward, and a second separation roller which is pressed to the second feed roller through the transfer path, and separates second and following paper sheets taken out together with the first paper sheet by giving a reverse separating force; a first detector which detects that a preceding paper sheet reaches the second separation unit; and a control unit which decelerates the peripheral speed of the first feed roller, when the first detector detects that a preceding paper sheet reaches the second separation unit.

According to another embodiment of the invention, there is provided a paper sheet separation and transfer apparatus comprising a take-out roller which rotates and contacts a paper sheet at one end of a stack of a plurality of paper sheets, and takes out the paper sheet onto a transfer path; a first separation unit having a first feed roller which contacts the paper sheet taken out onto the transfer path and rotates forward, and a first separation roller which is pressed to the first feed roller through the transfer path, and separates second and following paper sheets taken out together with the first paper sheet by giving a reverse separating force; a second separation unit having a second feed roller which contacts the paper sheet passed through the first separation unit and rotates forward, and a second separation roller which is pressed to the second feed roller through the transfer path, and separates second and following paper sheets taken out together with the first paper sheet by giving a reverse separating force; a state detection unit which detects the state that a plurality of paper sheets exist between the second feed roller and second separation roller; and a control unit which decelerates the peripheral speed of the first feed roller, when the state detection unit detects the state.

According to still another embodiment of the invention, there is provided a paper sheet separation and transfer apparatus comprising a take-out roller which rotates and contacts a paper sheet at one end of a stack of a plurality of paper sheets, and takes out the paper sheet onto a transfer path; a first separation unit having a first feed roller which contacts the paper sheet taken out onto the transfer path and rotates forward, and a first separation roller which is pressed to the first feed roller through the transfer path, and separates second and following paper sheets taken out together with the first paper sheet by giving a reverse separating force; a state detection unit which detects the state that a plurality of paper sheets exist between the first feed roller and first separation roller; and a control unit which decelerates the peripheral speed of the take-out roller, when the state detection unit detects the state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, detailed explanation will be given on embodiments of the present invention with reference to the accompanying drawings.

Figure 1:
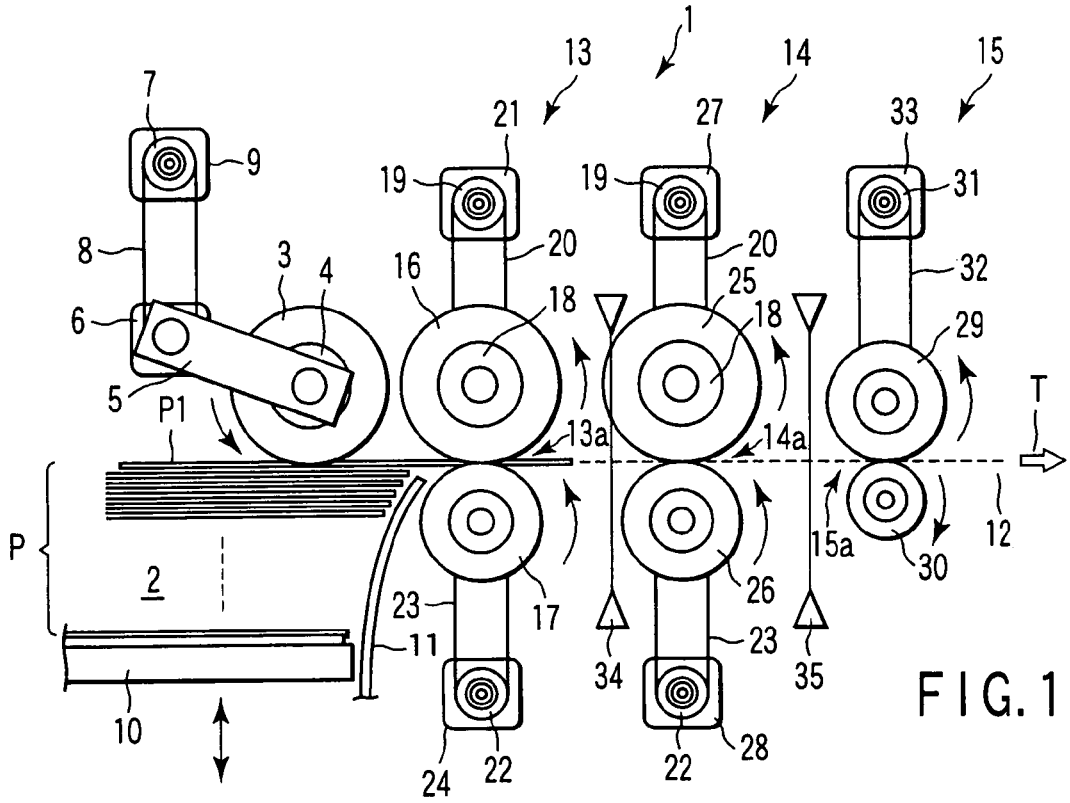
FIG. 1 is a schematic illustration showing a separation and transfer apparatus according to a first embodiment of the present invention.

FIG. 1 shows a schematic construction of a paper sheet separation and transfer apparatus 1 (hereinafter, simply referred to as a separation and transfer apparatus 1) according to the present invention.

The separation and transfer apparatus 1 has a housing 2 which contains a plurality of stacked paper sheets P. A take-out roller 3 is provided at the position contacting a paper sheet P1 at one end of the stack of paper sheets P contained in the housing 2. Each roller shown in FIG. 1 has two rollers separated from each other in the axial direction.

The take-out roller 3 is fixed to the rotary shaft through a one-way clutch 4, and the rotary shaft is fixed to the front end of a press arm 5. The rotary shaft of a press motor 6 is fixed to the base end of the press arm 5. Thus, the press arm 5 is swung by driving the press motor 6, and the take-out roller 3 is pressed to the paper sheet P1 at one end of the stack. The press arm 5 and press motor 6 function as a press mechanism of the present invention.

In this embodiment, a torque control motor is adopted for the press motor 6, and the pressing force of the take-out roller 3 to the paper sheet P1 can be changed optionally. The take-out roller 3 is freely rotatable in the arrow direction (the forward direction) in the drawing by the action of one-way clutch 4. Therefore, when transferring the paper sheet P in the arrow T direction (forward) in the drawing, the take-out roller 3 rotates together with the paper sheet P, and does not generate a reverse force disturbing the transfer of the paper sheet P, that is, a force along the tangential direction of the take-out roller (hereinafter, simply referred to as a tangential force).

A take-out motor 9 is connected to the rotary shaft of the take-out roller 3 through a plurality of pulleys 7 and timing belts 8. Namely, by driving the take-out motor 9, the take-out roller 3 is rotated in the arrow direction in the drawing. In this embodiment, a position control motor is adopted for the take-out motor 9, and the rotation speed, direction and amount (angle) of the take-out roller 9 can be controlled optionally.

On the opposite side of the housing 2 against the take-out roller 3, a backup plate 10 is provided to move a plurality of paper sheets P in the stack by pressing a paper sheet P at the other end of the stack, and to supply a paper sheet P1 at one end of the stack to a predetermined take-out position. The backup plate 10 is urged in the stacking direction by an actuator described later.

A guide member 11 is provided at the position adjacent to the housing 2, or the position opposite to the front end of the take-out direction of a plurality of paper sheets P. The guide member 11 is bent toward the nip of a first separation unit described later, and functions to guide the front end of each paper P in the transfer direction to the nip.

When the take-out roller 3 pressed by the press motor 6 to the paper sheet P at one end of the stack is rotated forward by the take-out motor 9, the paper sheet P1 supplied by the backup plate 10 to the predetermined take-out position is taken out onto a transfer path 12. In this time, by the friction between the paper sheets P, second and subsequent sheets may be taken out together with the first paper sheet P1.

On the transfer path 12 of the downstream side of the take-out roller 3, a first separation unit 13, a second separation unit 14 and a pull-out unit 15 are sequentially arranged close to each other along the transfer direction T.

The first separation unit 13 has a first feed roller 16 which contacts the paper sheet P taken out onto the transfer path 12 and rotates forward along the transfer direction T, and a first separation roller 17 which is arranged opposite to the first feed roller 16 through the transfer path 12. The first separation roller 17 is pressed by a predetermined pressure to the first feed roller 16 in the state that no paper sheet P exists on the transfer path 12.

The first feed roller 16 is arranged on the same side as the take-out roller 3 against the transfer path 12, that is, the upper side of the transfer path 12 in the drawing. The first feed roller 16 is attached to the rotary shaft through a one-way clutch 18. Therefore, when the paper sheet P is transferred in the arrow T direction along the transfer path 12, the first feed roller 16 rotates freely forward together with the paper sheet P, and does not generate a force (a tangential force) in the direction of disturbing the transfer of the paper sheet P.

A first feed motor 21 is connected to the rotary shaft of the first feed roller 16 through a plurality of pulleys 19 and timing belts 20. Namely, by driving the first feed motor 21, the first feed roller 16 is rotated. In this embodiment, a position control motor is adopted for the first feed motor 21, and the rotation speed, direction and amount (angle) of the first feed roller 16 can be controlled optionally.

To the rotary shaft of the first separation roller 17, a first separation motor 24 is connected through a plurality of pulleys 22 and timing belts 23. The first separation motor 24 gives the first separation roller 17 a force in the direction to rotate the first separation roller 17 in the arrow direction in the drawing (the reverse direction). In this embodiment, a torque control motor is adopted for the first separation motor 24, and a reverse separating force given by the first separation motor 24 to the first separation roller 17, that is, a separating force given by the first separation roller 17 to the paper sheet P in the tangential direction (hereinafter, sometimes referred to as a separation tangential force) can be changed optionally.

However, a separation force given by the first separation motor 24 to the first separation roller 17 is set to the degree that the first separation roller 17 rotates forward together with the first feed roller 16, in the state that there is no paper sheet P to transfer on the transfer path 12, or the state that one paper sheet P is transferred. In other words, even if the first separation motor 24 tries to rotate the first separation roller 17 in the reverse direction, when no paper sheet P exists in the nip 13*a* in the space to the first feed roller 16, or when one paper sheet P exists, the first separation roller 17 is rotated forward.

When a plurality of paper sheets P is fed overlapped to the first separation unit 13, the preceding first paper sheet P1 is fed in the arrow T direction by the first feed roller 16 around which the first paper sheet P1 is rotated forward, the first separation roller 17 gives a separating force (a separating tangential force) reverse to the direction T to the second and subsequent paper sheets P taken out together with the first paper sheet P1 in being overlapped therewith, and the second and subsequent paper sheets P are separated from the first paper sheet P1. Of course, if the second and subsequent paper sheets P are not taken out together when the first paper sheet P1 is taken out, the first separation roller 17 rotates together with the first paper sheet P1, and the first paper sheet P1 passes through the first separation unit 13.

The second separation unit 14 provided on the downstream side of the first separation unit 13 along the paper sheet transfer direction T has the same structure as the first separation unit 13. Thus, the same reference numerals are given to the components having the similar functions, and detailed explanation will be omitted. However, to simplify the explanation, different reference numerals are given to specific components. Namely, the second separation unit 14 has a second feed roller 25 driven and rotated by a second feed motor 27, and a second separation roller 26 given a separation force by a second separation motor 28. A position control motor is adopted for the second feed roller 27, and a torque control motor is adopted for the second separation motor 28. The second separation unit 14 functions to separate a plurality of paper sheets which are fed overlapped without being separated by the first separation unit 13.

The pull-out unit 15 provided on the downstream side of the second separation unit 14 along the transfer direction T has a pull-out roller 29 and a pinch roller 30. The pull-out roller 29 is provided on the same side as the take-out roller 3 against the transfer path 12 (the upper side in the drawing). The pinch roller 30 is pressed by a predetermined pressure to the pull-out roller 29 through the transfer path 12.

A pull-out motor 33 is connected to the rotary shaft of the pull-out roller 29 through a plurality of pulleys 31 and timing belts 32. Namely, by driving the pull-out motor 33, the pull-out roller 29 is rotated in the arrow direction in the drawing. In this embodiment, a position control motor is adopted for the pull-out motor 33, and the rotation speed and amount (angle) of the pull-out roller 29 can be controlled optionally.

When the front end in the transfer direction of the paper sheet P passed through the second separation unit 14 is fed to the nip between the pull-out roller 29 and pinch roller 30, the paper sheet P is pulled out from the second separation unit 14 by the pull-out unit 15. The paper sheet P pulled out by the pull-out unit 15 is transferred to a not-shown processing unit in the later stage and processed there.

On the transfer path 12, a first sensor 34 (a first detector) and a second sensor 35 (a second detector) are provided. Each sensor 34 and 35 has a light emitting part and a light receiving part, detects the passage of the paper sheet P by the fact that the paper sheet P interrupts the light from the light emitting part to the light receiving part.

The first sensor 34 is provided at the position where the light crosses the transfer path 12 between the nip 13*a* located between the first feed roller 16 and first separation roller 17 (hereinafter, called the nip 13*a* of the first separation unit 13) and a nip 14*a* located between the second feed roller 25 and second separation roller 26 (hereinafter, called the nip 14*a* of the second separation unit 14). The second sensor 35 is provided at the position where the light crosses the transfer path 12 between the nip 14*a* of the second separation unit 14 and a nip 15*a* located between the pull-out roller 29 and pinch roller 30 (hereinafter, called the nip 15*a* of the pull-out unit 15).

Figure 2:
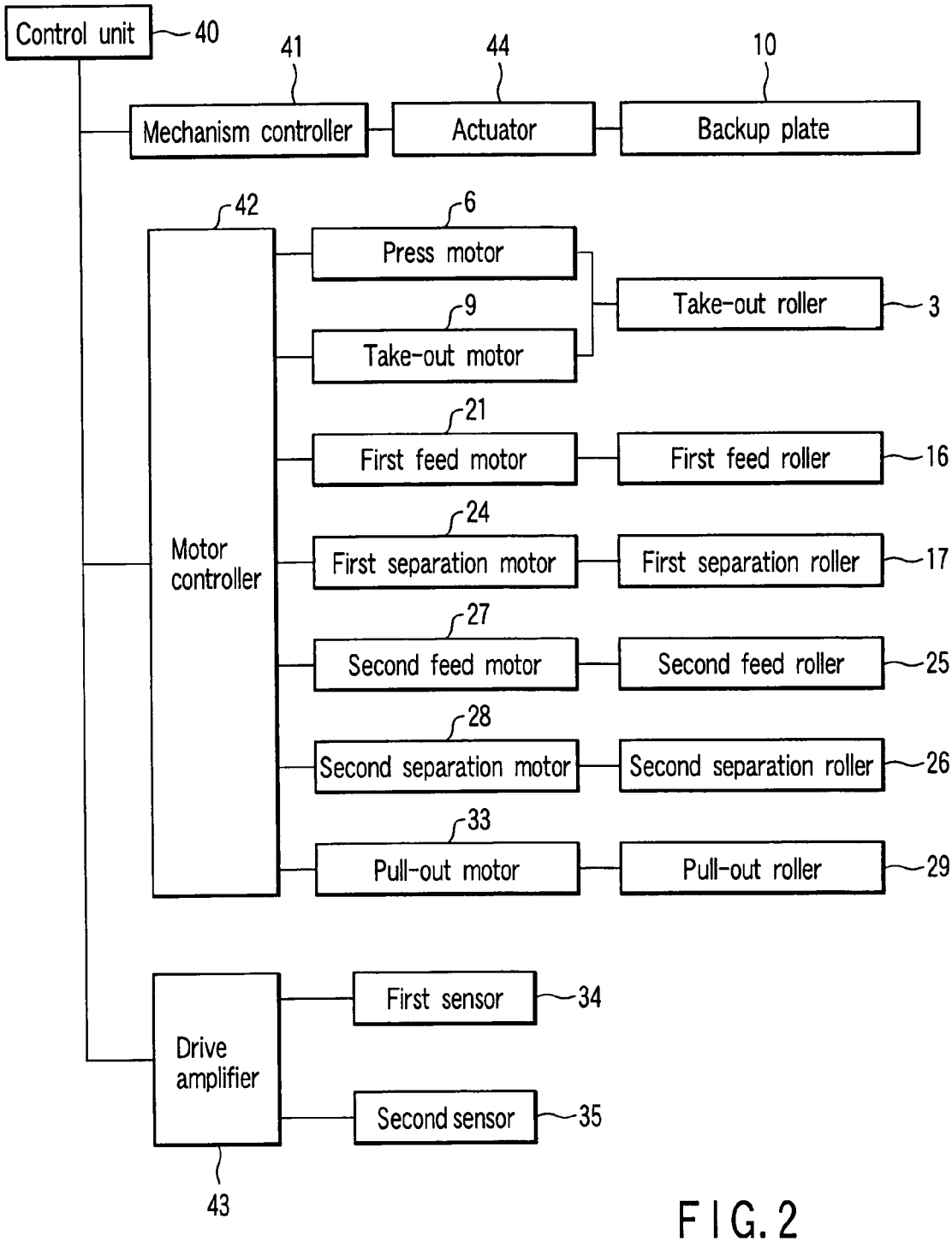
FIG. 2 is a block diagram of a control system which controls operation of the separation and transfer apparatus of FIG. 1.

FIG. 2 shows a block diagram of a control system which controls the operation of the separation and transfer apparatus 1 with the above structure.

The separation and transfer apparatus 1 has a control unit 40 which controls the apparatus. The control unit 40 is connected with a mechanism controller 41, a motor controller 42 and a drive amplifier 43. The mechanism controller 41 is connected with an actuator 44 of the aforementioned backup plate 10.

The motor controller 42 is connected with the press motor 6 which presses the take-out roller 3 to the paper sheet P1, the take-out motor 9 which rotates the take-out roller 3, a first feed motor 21 which rotates the first feed roller 16, a first separation motor 24 which gives the first separation roller 17 a reverse separation force, the second feed motor 27 which rotates the second feed roller 25, the second separation motor 28 which gives the second separation roller 26 a reverse separation force, and a pull-out motor 33 which rotates the pull-out roller 29.

The drive amplifier 43 is connected with the aforementioned first sensor 34 and second sensor 35. Thus, the output signals from the sensors 34 and 35 are sent to the control unit 40.

Figure 3:
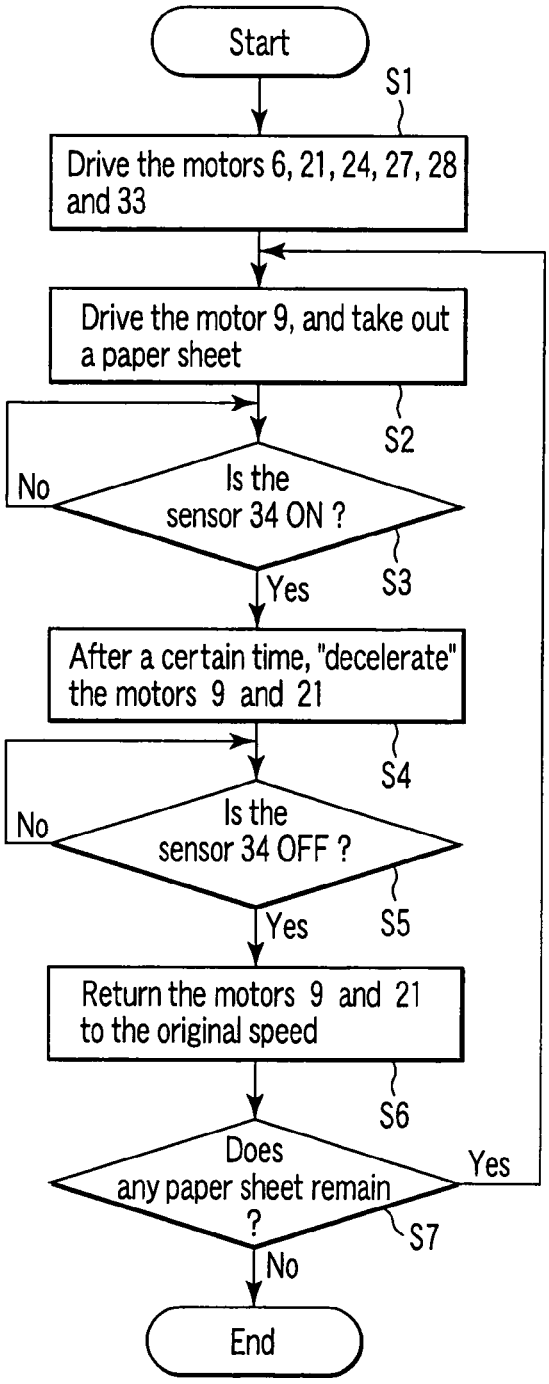
FIG. 3 is a flowchart for explaining a first operation example of the separation and transfer apparatus of FIG. 1.

Next, a first operation example of the separation and transfer apparatus 1 with the above-mentioned structure will be explained with reference to the flowchart of FIG. 3.

First, the control unit 40 controls the motor controller 42, drives the press motor 6, first feed motor 21, first separation motor 24, second feed motor 27, second separation motor 28 and pull-out motor 33, presses the take-out roller 3 to the paper sheet P1 at one end of the stack by a predetermined pressure, rotates forward the first feed roller 16, second feed roller 25 and pull-out roller 29 at a predetermined speed, and gives a predetermined separation torque to the first separation roller 17 and second separation roller 26 (Step 1). In this state, as the paper sheet P is not transferred through the transfer path 12, the first separation roller 17 rotates together with the first feed roller 16, and the second separation roller 26 rotates together with the second feed roller 25.

In this state, the control unit 40 controls the motor controller 42, drives the take-out motor 9 and rotates the take-out roller 3 forward at a predetermined speed, and takes out the paper sheet P1 at one end of the stack contacted and rotated by the take-out roller 3 onto the transfer path 12 (Step 2). In this case, the second and subsequent paper sheets may be taken out overlapped together with the first paper sheet P1 onto the transfer path 12.

In steps 1 and 2, the motor controller 42 controls the rotation speeds of the motors 9, 21, 27 and 33, so that the peripheral speeds of the take-out roller 3, first feed roller 16, second feed roller 25 and pull-out roller 29 become V1, V2, V3 and V4, respectively. Here, the motor controller 42 controls the rotation speeds of the rollers 3, 16, 25 and 29, so that the peripheral speeds V1, V2, V3 and V4 of the rollers satisfy the following expression:

$$V1 \leqq V2 \leqq V3 \leqq V4$$

As explained above, by making the peripheral speeds of the rollers 3, 16, 25 and 29 different, a transfer gap can be taken between the paper sheets P taken out continuously onto the transfer path 12. Further, by making the speeds of the rollers different to satisfy the above expression, a buckle in the paper sheet P on the way of transfer can be prevented. However, if the peripheral speed difference is too large, the transfer gap will become unnecessarily large. Therefore, it is necessary to adjust the speed difference to an appropriate value.

When a certain time passes after detecting that the front end in the transfer direction of the paper sheet P1 taken out onto the transfer path 12 in step 2 has reached the first sensor 34 by passing through the nip 13*a* of the first separation unit 13 (Step 3; YES), the control unit 40 decelerates the take-out motor 9 and first feed motor 21, and decelerates the peripheral speeds of the take-out roller 3 and first feed roller 16 (Step 4). After the deceleration, the peripheral speeds V1' and V2' of the take-out roller 3 and feed roller 16 satisfy the following expression:

$$V1' \leqq V2' < V2$$

The above certain time is the time from the arrival of the front end in the transfer direction of the paper sheet P1 at the first sensor 34 to the arrival at the nip 14*a* of the second separation unit 14, that is, the time determined by the peripheral speed of the first feed roller 16 and the distance from the position where the first sensor 34 crosses the transfer path 12 to the nip 14*a* of the second separation unit 14. In other words, in step 4, the control unit 40 decelerates the take-out motor 9 and first feed motor 21 at the timing that the front end of the paper sheet P1 in the transfer direction reaches the nip 14*a* of the second separation unit 14. The term "decelerate" mentioned here and the term "decelerate" described in the Claims indicate the control to decelerate the roller rotating forward, and include all states from stop of the roller after deceleration to start of rotation in the reverse direction.

Thereafter, the control unit 40 detects that the rear end of the paper sheet P1 in the transfer direction passes through the first sensor 34 (Step 5; YES), and accelerates the take-out motor 9 and first feed motor 21 to return the peripheral speeds of the take-out roller 3 and first feed roller 16 to V1 and V2, respectively (Step 6). Then, the control unit 40 repeats the control of steps 2 to 6 until all paper sheets P contained in the housing 2 are taken out (Step 7: NO).

Further, the control unit 40 monitors the time that the paper sheet P passes through the first sensor 34, while executing the control in the above steps 2 to 6, and when the passing time becomes longer than a certain predetermined value continuously over a predetermined numbers of time, the control unit 40 judges that there is a possibility that the overlapped feed of the paper sheet P occurs frequently exceeding the separating capacity in the first separation unit 13, and controls the press motor 6 to decrease the pressing force of the take-out roller 3 to the paper sheet P.

As describe above, in the first operation example, the peripheral speeds of the take-out roller 3 and first feed roller 16 are "decelerated" at the time when the front end in the transfer direction of the paper sheet P1 taken out onto the transfer path 12 reaches the nip 14*a* of the second separation unit 14, and if there is second and subsequent paper sheets taken out together with the paper sheet P1, it is possible to prevent a defect of causing a wrinkle in the paper sheet P on and after the second sheet during the separating operation in the second separation unit 14.

Conversely, when the "decelerate" control explained in the first operation example is not adopted, for example, in the state that the first paper sheet P1 and second paper sheet P2 are being separated in the second separation unit 14 and that the rear end of the paper sheet P1 in the transfer direction passes through the nip 13*a* of the first separation unit 13, the front end of the second paper sheet P2 is returned to the reverse direction by the second separation roller 26 of the second separation unit 14, and the rear end of the second paper sheet P2 is fed forward by the first feed roller 16 of the first separation unit 13, and the second paper sheet P2 buckles and causes a wrinkle between two nips 13*a* and 14*a*.

Namely, in this case, if the above mentioned "decelerate" control of the present invention is adopted, the peripheral speed of the first feed roller 16 which feeds forward the rear end of the second paper sheet P2 can be delayed at least, decreasing the possibility of buckling the second paper sheet P2 between the nips 13*a* and 14*a*. As described above, the term "decelerate" mentioned here includes "stop" and "reverse", and for example, when the paper sheet P is a relatively flimsy bill, it is possible to prevent substantially a defect of causing a wrinkle in the second paper sheet P2 by "stopping" the take-out roller 3 and "reversing" the first feed roller 16 to meet the peripheral speed of the second separation roller 26.

Namely, it is necessary to select appropriate degree of "deceleration" of the take-out roller 3 and first feed roller 16 according to the physical characteristics of the paper sheet P, such as flexibility, material, thickness and hardness. For example, when separating and transferring relatively thick and hard paper sheets P such as postal matter, the above-mentioned buckling can be prevented simply by "decelerating" slightly the take-out roller 3 and first feed roller 16. The buckling problem may also be solved by decreasing the pressing force of the take-out roller 3 by the press motor 6 instead of "decelerating" the take-out roller 3.

In the above-mentioned first operation example, explanation has been given of the case that two rollers 3 and 16 are "decelerated" by monitoring only the output of the first sensor 34. However, the separation and transfer apparatus 1 of this embodiment has two separation units 13 and 14, and it is unknown which separation unit separates the second and subsequent paper sheets P taken out together with the first paper sheet P1. Thus, the processing time of the paper sheet P may become unnecessarily long under certain conditions.

Figure 4:
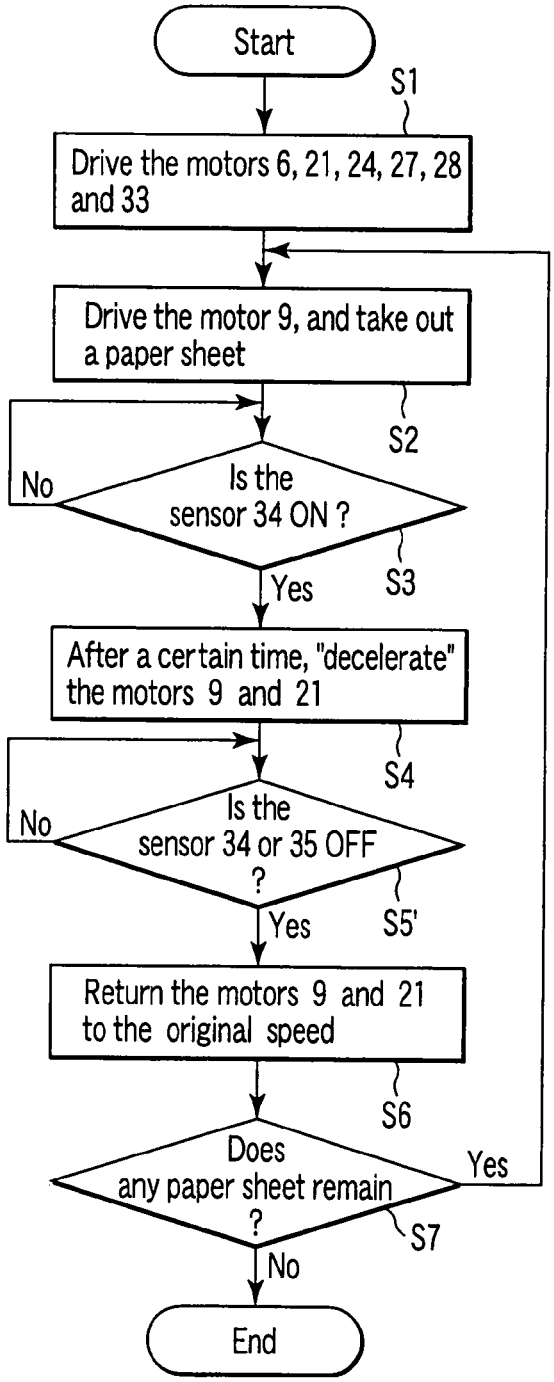
FIG. 4 is a flowchart for explaining a second operation example of the separation and transfer apparatus of FIG. 1.

FIG. 4 is a flowchart showing a second operation example, in which the outputs of the first and second sensors 34 and 35 are monitored, the output signals of two sensors 34 and 35 are ored, and two rollers 3 and 16 are "decelerated". This second operation example is the same as the aforementioned first operation example except that the processing of step 5 is different.

Namely, in the processing of step 5' different from the first operation example, the control unit 40 monitors the output of the first sensor 34 and detects that the rear end of the first paper sheet P1 in the transfer direction passes, and monitors the output of the second sensor 35 and detects that the rear end of the first paper sheet P1 in the transfer direction passes. When one of the first and second sensors 34 and 35 detects the passage of the rear end of the first paper sheet P1 in the transfer direction (Step 5'; YES), the control unit 40 return the peripheral speeds of the rollers 3 and 16.

By the above operation of the control unit 40, for example, when the second paper sheet P2 is taken out together with the first paper sheet P1 and these two overlapped sheets are not separated by the first separation unit 13 but separated by the second separation unit 14, the control unit 40 "decelerates" continuously two rollers 3 and 16 until the rear end of the second paper sheet P2 in the transfer direction passes through the first sensor 34 in the first operation example, but in the second operation example, the peripheral speeds of the rollers 3 and 16 can be returned to the original speed at the time when the second sensor 35 detects the passage of the rear end of the first paper sheet P1 in the transfer direction. Namely, in this case, the time of "decelerating" the two rollers 3 and 16 can be reduced by adopting the second operation example.

As described above, by adopting the second operation example, the same effect as that obtained when adopting the first operation example can be obtained, and the processing time can be reduced.

Figure 5:
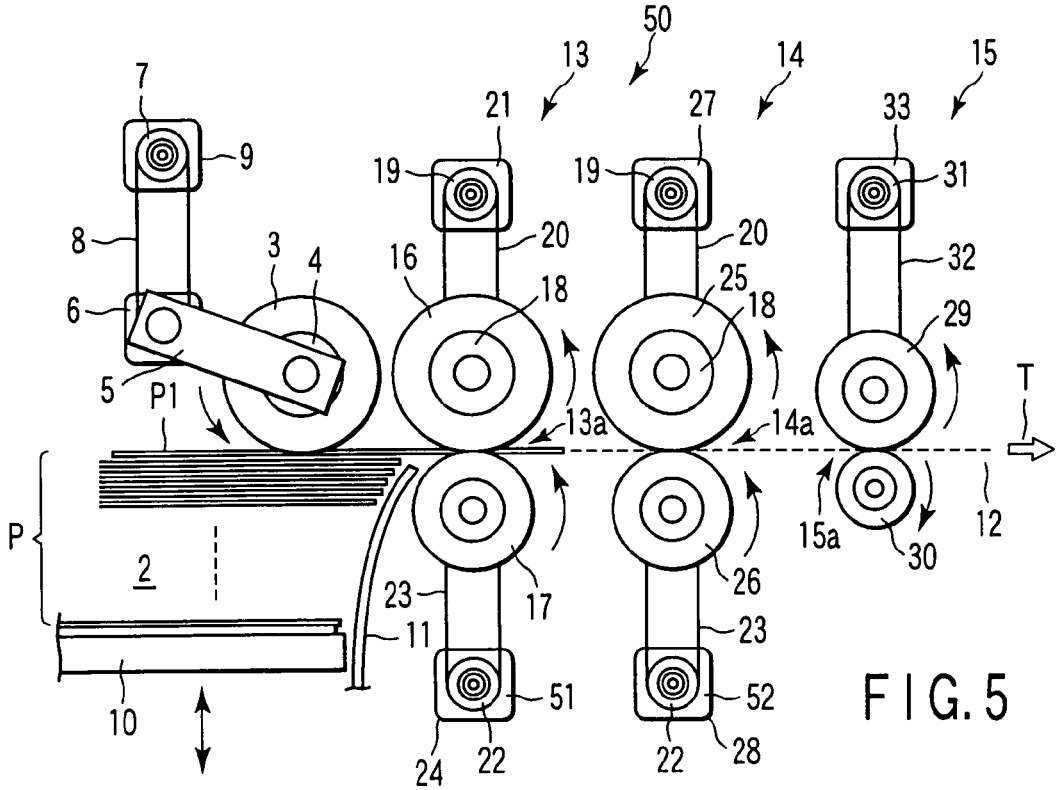
FIG. 5 is a schematic illustration showing a separation and transfer apparatus according to a second embodiment of the present invention.

FIG. 5 shows a schematic construction of a separation and transfer apparatus 50 according to a second embodiment of the present invention. In the separation and transfer apparatus 50, the first and second separation motors 24 and 28 contain encoders 51 and 52 (state detection unit), respectively. In other words, the separation and transfer apparatus 50 has the same structure as the aforementioned separation and transfer apparatus 1 except that the encoders 51 and 52 are used instead of the first and second sensors 34 and 35. Thus, the same reference numerals are given to the components having the same functions as in the separation and transfer apparatus 1, and detailed explanation of these components will be omitted.

The encoder 51 contained in the first separation motor 24 detects the rotation speed of the first separation roller 17, and the encoder 52 contained in the second separation motor 28 detects the rotation speed of the second separation roller 26. The output ends of two encoders 51 and 52 are connected to the control unit 40. In other words, in this embodiment, the control unit 40 always monitors the rotation speeds of the first and second separation rollers 17 and 26 through the encoders 51 and 52.

Figure 6:
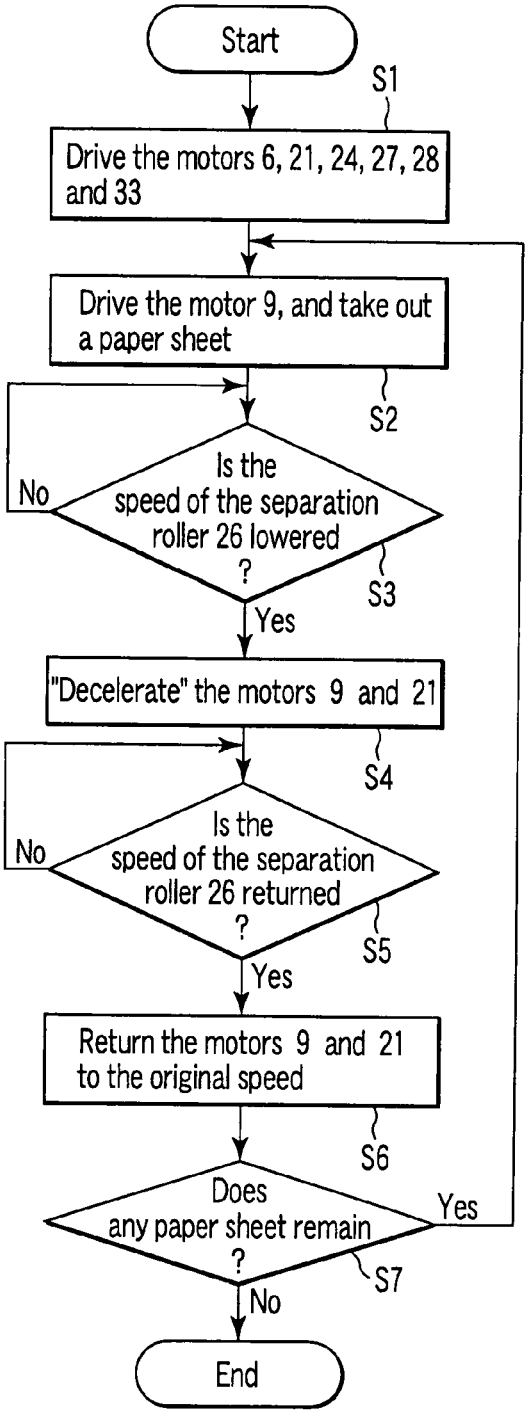
FIG. 6 a flowchart for explaining a third operation example of the separation and transfer apparatus of FIG. 5.

FIG. 6 shows a flowchart for explaining a third operation example of the separation and transfer apparatus 50 with the above structure. This third operation example is basically the same as the first operation example except that the state of the paper sheet P is detected by the encoder 52.

Namely, after rotating the take-out roller 3 and taking out the first paper sheet. P1 (Steps 1 and 2), the control unit 40 monitors the output of the encoder 52 contained in the second separation motor 28 (Step 3), regards the drop of the rotation speed of the second separation roller 26 as a trigger (Step 3; YES), "decelerates" the take-out motor 9 and first feed motor 21, and "decelerates" the peripheral speeds of the take-out roller 3 and first feed roller 16 (Step 4). The term "decelerate" mentioned here includes "stop" and "reverse" as in the first embodiment.

Figure 7:
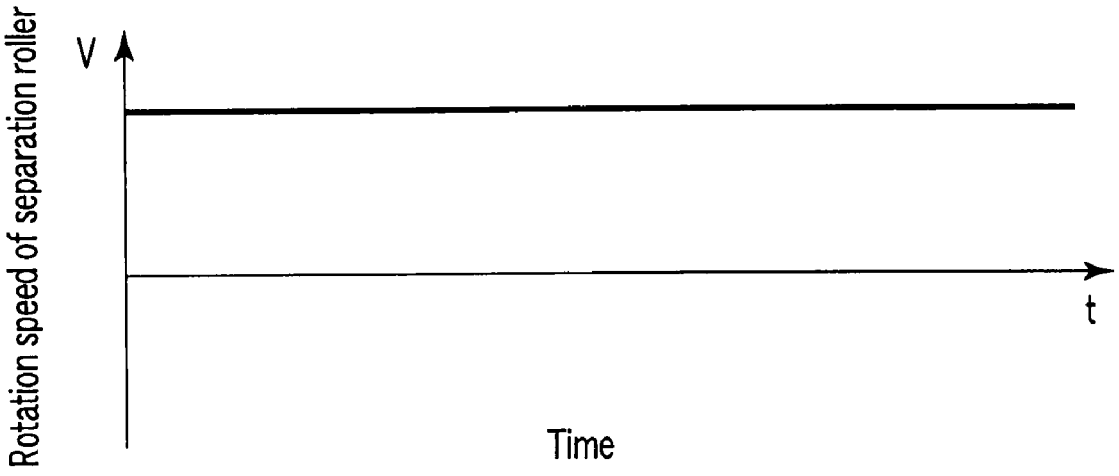
FIG. 7 is a graph showing changes with time of the rotation speed of a separation roller in the state that the separation roller is co-rotated.
Figure 8:
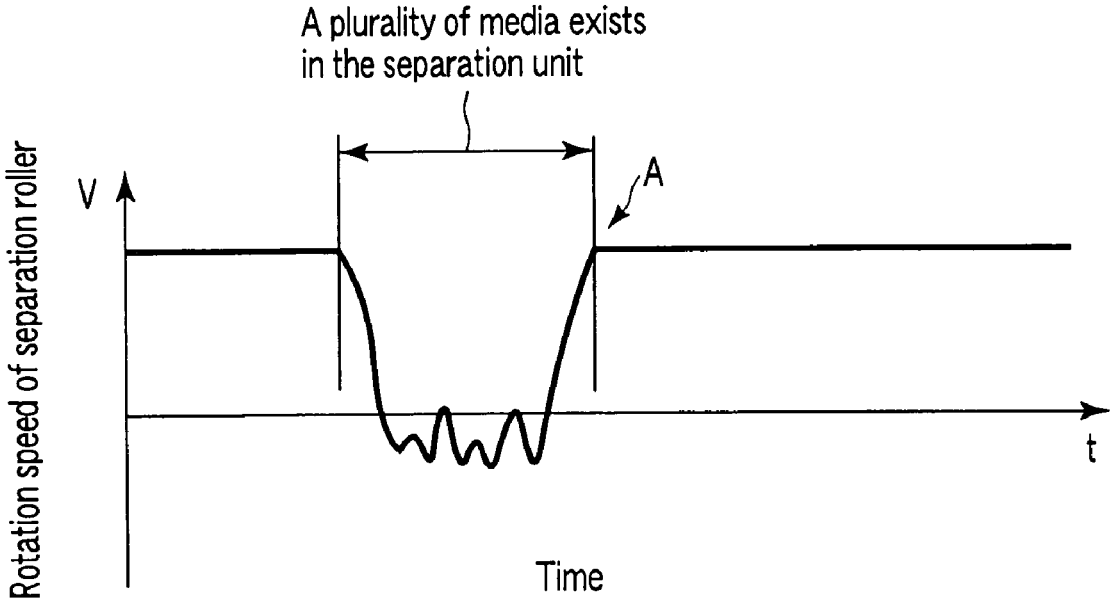
FIG. 8 is a graph showing changes with time of the rotation speed of a separation roller during the separating operation.

When no paper sheet P exists in the nip 14*a* and when one paper sheet P exists in the nip 14*a*, the second separation roller 26 rotates together with the second feed roller 25 at the same speed. FIG. 7 shows changes with time of the rotation speed of the second separation roller 26 in the state rotated together with the second feed roller 25. On the other hand, when a plurality of overlapped paper sheets P passes through the nip 14*a* of the second separation unit 14, that is, when a plurality of paper sheets P is separated by the second separation unit 14, the rotation speed of the second separation roller 26 is changed with time as shown in FIG. 8. Namely, by monitoring the changes in the rotation speed of the second separation roller 26 through the encoder 52, it is possible to detect the state of the paper sheet P passing through the nip 14*a* of the second separation unit 14.

After "decelerating" two rollers 3 and 16 in step 4, the control unit 40 regards the return of the rotation speed of the second separation roller 26 to the original speed (the arrow A in FIG. 8) as a trigger (Step 5; YES), judges that the first and second paper sheets P1 and P2 are separated, and accelerates the take-out motor 9 and first feed motor 21 so as to return the peripheral speeds of the take-out roller 3 and first feed roller 16 to V1 and V2, respectively (Step 6).

The control unit 40 repeats the controls of steps 2 to 6 until all paper sheets P contained in the housing 2 are taken out (Step 7; NO).

When the rotation speed of the second separation roller 26 is lowered (Step 3; YES), the control unit 40 controls the first separation motor 24 to reduce the separation force given to the first separation roller 17. Namely, when the rotation speed of the second separation roller 26 is lowered as described above, the separation of the paper sheet P2 in the second separation unit 14 can be judged, and the separating operation in the first separation unit 13 becomes basically unnecessary.

Further, when the rotation speed of the second separation roller 26 is lowered (Step 3; YES), the control unit 40 controls the press motor 6 to decrease the pressing force of the take-out roller 3 on the paper sheet P2. By this operation, the forward force (tangential force) given to the separated paper sheet P2 can be decreased further, and the paper sheet P2 can be easily returned in the reverse direction.

The control unit 40 regards the return of the rotation speed of the second separation roller 26 to the original speed as a trigger (Step 5; YES), judges that the separating operation is finished, returns the separation force given to the first separation roller 17 to the original value, and returns the pressing force of the take-out roller 3 to the paper sheet P to the original value.

By operating the separation and transfer unit 50 according to the third operation example as explained above, the same effect as the first operation example can be obtained, and the state of the paper sheet P in the second separation unit 14 can be grasped more exactly, enabling more reliable separation and transfer.

In the above third operation example, explanation has been given on a method of preventing a wrinkle caused by the buckling of the paper sheet P2 between the nips 13*a* and 14*a* of the first and second separation units 13 and 14, by monitoring the state of the paper sheet P in the second separation unit 14. The paper sheep P may buckle between the position where the take-out roller 3 contacts and rotates with the paper sheet P, and the nip 13*a* of the first separation unit 13.

Figure 9:
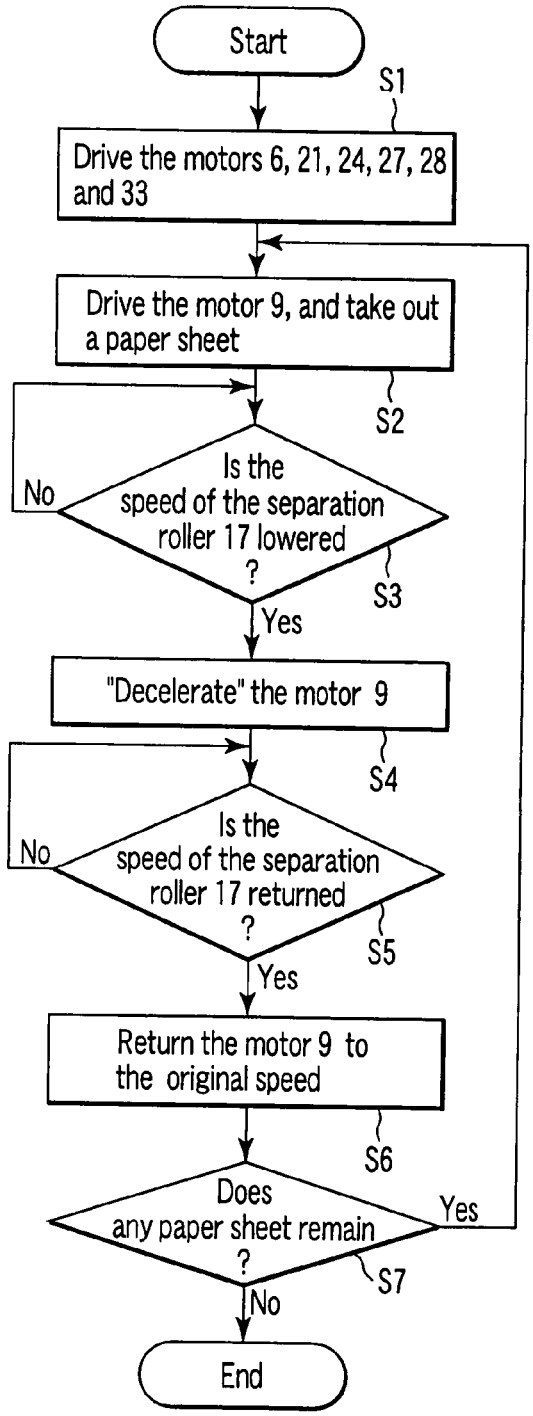
FIG. 9 is a flowchart for explaining a fourth operation example of the separation and transfer apparatus of FIG. 5.

FIG. 9 is a flowchart showing a fourth operation example for preventing a buckle of the paper sheet P between the take-out roller 3 and nip 13*a*. According to the drawing, after the first paper sheet P1 is taken out onto the transfer path 12 (Steps 1, 2), the control unit 40 regards the drop of the rotation speed of the first separation roller 17 of the first separation unit 13 as a trigger (Step 3; YES), and controls the take-out motor 9 to "decelerate" the take-out roller 3 (Step 4). The term "deceleration" includes "stop" and "reverse".

The control unit 40 regards the return of the rotation speed of the first separation roller 17 to the original speed as a trigger after the end of the separating operation in the first separation unit 13 (Step 5; YES), and controls the take-out motor 9 to return the peripheral speed of the take-out roller 3 to the original speed (Step 6). The control unit 40 repeats the control of steps 2 to 6 until all paper sheets P contained in the housing 2 are taken out (Step 7; NO).

When the rotation speed of the second separation roller 26 is lowered (Step 3; YES), the control unit 40 controls the first separation motor 24 to reduce the separation force given to the first separation roller 17. Namely, when the rotation speed of the second separation roller 26 is lowered as described above, the separation of the paper sheet P2 in the second separation unit 14 can be judged, and the separating operation in the first separation unit 13 becomes basically unnecessary.

In addition, when the rotation speed of the first separation roller 17 is lowered, the control unit 40 controls the first separation motor 24 and reduces the separating force given to the first separation roller 17. Namely, when the rotation speed of the first separation roller 17 is lowered, the rotation speed of the take-out roller 3 is decelerated, the pressing force of the take-out roller 3 is reduced, and the paper sheet can be easily separated. Therefore, the paper sheet is prevented from being moved back excessively, by reducing the separating force of the first separation roller 17.

When the rotation speed of the first separation roller 17 is lowered (Step 3; YES), the control unit 40 controls the press motor 6 so as to lower the pressing force of the take-out roller 3 on the paper sheet P, and makes it easy to return the paper sheet P2 in the reverse direction. Further, when the rotation speed of the first separation roller 17 is returned to the original speed (Step 5; YES), the control unit 40 controls the press motor 6 so as to return the pressing force of the take-out roller 3 to the original value.

As explained above, in the fourth operation example, since the take-out roller 3 is "decelerated" and the pressing force of the take-out roller 3 is lowered at the time when the separating operation is started in the first separation unit 13, the second paper sheet P2 taken out together with the first paper sheet P1 can be easily returned, and the buckling of the paper sheet P2 between the nip of the take-out roller 3 and nip 13*a* of the first separation unit 13 can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above embodiment, explanation has been given of the case that the overlapped state of paper sheet P is detected by using the sensors 34 and 35 or encoders 51 and 52. The invention is not to be limited to this. The overlapped state of paper sheet P may be detected by detecting the thickness of paper sheet P. Further, the second embodiment uses the encoders 51 and 52 of the type incorporated in the separation motors 24 and 28, but an external encoder may be used. Or, it is permitted to use a tachogenerator for detecting the rotation speed.

Further, the stacking direction of the paper sheet P is shown vertical in FIG. 1 and FIG. 5, but the horizontal direction is permitted, and the stacking is not to be limited to the gravity direction. Further, in the above embodiment, the paper sheets P are taken out one by one onto the transfer path 12 by contacting and rotating the take-out roller 3 with the stacked paper sheets P, but a take-out belt can be used instead of the take-out roller 3. It is also permitted to use a pair of pull-out belts instead of the pull-out roller 29 and pinch roller 30.

What is claimed is:

1. A paper sheet separation and transfer apparatus comprising:

a supply mechanism which moves a stack of a plurality of paper sheets in a stacking direction and supplies a first paper sheet placed at one end of the stack to a take-out position;

a take-out roller which rotates and contacts the first paper sheet supplied to the take-out position by the supply mechanism to take out the first paper sheet onto a transfer path;

a press mechanism which presses the take-out roller to the first paper sheet at one end of the stack;

a feed roller which is brought into contact with the first paper sheet taken out onto the transfer path;

a separation roller which is brought into contact with the feed roller, with the transfer path interposed therebetween, and is provided with a rotational force exerted in a direction opposite to a direction of rotation of the feed roller, the rotational force generating a separating force exerted in a direction opposite to a direction of transfer of the paper sheets on second and subsequent paper sheets taken out unintentionally and simultaneously with the first paper sheet, thereby separating the second and subsequent paper sheets from the first paper sheet;

a rotational speed detection unit which detects a rotational speed of the separation roller;

a state detection unit which detects a state in which the second and subsequent paper sheets are separated from the first paper sheet by the separation roller, based on a detection result of the rotational speed detection unit; and a control unit which decelerates the peripheral speed of the take-out roller and controls the pressing mechanism to reduce a pressing force of the take-out roller, when the state detection unit detects said state.

2. The paper sheet separation and transfer apparatus, according to claim 1, wherein the control unit returns the peripheral speed of the take-out roller to the original speed and controls the press mechanism to return the pressing force of the take-out roller to the original force, when said state is reset.

3. The paper sheet separation and transfer apparatus according to claim 1, wherein the control unit lowers the separating force of the first separation roller, when the state detection unit detects said state.

* * * * *